US006536875B1

(12) United States Patent
Pan

(10) Patent No.: US 6,536,875 B1
(45) Date of Patent: Mar. 25, 2003

(54) ACTUATOR APPARATUS, PROCESS OF FORMING THEREOF AND METHOD OF ACTUATION

(75) Inventor: Alfred I-Tsung Pan, Sunnyvale, CA (US)

(73) Assignee: Hewlett-Packard Development Company, Houston, TX (US)

( * ) Notice: Subject to any disclaimer, the term of this patent is extended or adjusted under 35 U.S.C. 154(b) by 0 days.

(21) Appl. No.: 10/210,607

(22) Filed: Jul. 31, 2002

(51) Int. Cl.[7] ..... B41J 2/04
(52) U.S. Cl. ..... 347/54

(58) Field of Search ..... 347/54, 68, 70, 347/71, 72, 50, 40, 20, 44, 47, 27, 63; 399/261; 361/700; 310/328–330; 29/890.1

(56) References Cited

U.S. PATENT DOCUMENTS 6,236,491 B1 5/2001 Goodwin-Johansson

*Primary Examiner*—Raquel Yvette Gordon

(57) ABSTRACT

An actuator apparatus, process of forming thereof, and method of actuation are described in which a flexible member having opposing surface electrodes positioned between two substrates having opposing surface electrodes is caused to move by charging and discharging the opposing flexible member electrodes during first and second operative cycles.

21 Claims, 5 Drawing Sheets

ACTUATOR APPARATUS, PROCESS OF FORMING THEREOF AND METHOD OF ACTUATION

FIELD OF THE INVENTION

The present invention relates to an actuator apparatus, process of forming thereof, and method of actuation, and in particular, this disclosure provides an electrostatic actuator apparatus, process, and method of electrostatic actuation.

BACKGROUND OF THE INVENTION

In general an actuator can be defined as a mechanism that causes a device to be turned on or off, adjusted or moved by converting various types of energies such as electric energy or chemical energy into kinematic energy. Small scale (i.e., miniature) actuators are referred to as micro-actuators. Actuators with a microstructure are often formed using semiconductor processing Different types of actuators are categorized by the manner in which energy is converted. For instance, electrostatic actuators convert electrostatic forces into mechanical forces. Piezoelectric actuators use piezoelectric material to generate kinematic energy. Electromagnetic actuators convert electromagnetic forces into kinematic energy using a magnet and coil windings.

Electrostatic actuators are used in micro-electromechanical systems (MEMS) for producing fine positional adjustments. For instance, micro actuators are known to be employed in ink jet heads for ink jet printers.

The present invention relates to an electrostatic actuator apparatus, process of forming thereof, and method.

SUMMARY OF THE INVENTION

According to one embodiment of the actuator apparatus an apparatus includes first and second spaced apart substrates. The first substrate has a first surface including a first electrode and the second substrate has a second surface that opposes the first surface and includes a second electrode. A flexible member is positioned between the first and second surfaces. The flexible member has a first member surface positioned opposite to the first surface and a second member surface positioned opposite to the second surface. A first distal end of the flexible member is fixedly attached to the first surface and a second distal end of the flexible member is fixedly attached to the second surface. A third electrode is formed on the first member surface and is positioned opposite to the first electrode. A fourth electrode is formed on the second member surface and is positioned opposite to the second electrode.

During a first operative cycle the third electrode portion is charged thereby causing the third electrode to be drawn towards the first surface resulting in a first movement of the member and in a second operative cycle the third electrode is discharged. During a second operative cycle the fourth electrode portion is charged thereby causing the fourth electrode to be drawn towards the second surface resulting in a second movement of the member and in the first operative cycle the fourth electrode is discharged.

According to one embodiment of the present invention a method of actuation is performed by initially providing first and second spaced apart substrates that have first and second opposing surfaces, respectively, where each surface has a first electrode and a second electrode, respectively. In addition, a flexible member is provided that is positioned between the surfaces and having a first member surface positioned opposite to the first surface and a second member surface positioned opposite to the second surface, in which the flexible member has a first distal end fixedly attached to the first surface and having a second distal end fixedly attached to the second surface is provided. A third electrode formed on the first member surface and positioned opposite to the first electrode and a fourth electrode formed on the second member surface and positioned opposite to the second electrode.

During a first operative cycle, the third electrode portion is charged and the first electrode is oppositely charged such that the third electrode is drawn towards the first surface resulting in a first movement of the member. In a second operative cycle the third electrode is discharged.

During a second operative cycle, the fourth electrode portion is charged and the second electrode is oppositely charged such that the fourth electrode is drawn towards the second surface resulting in a second movement of the member. In the first operative cycle, the fourth electrode is discharged.

DETAILED DESCRIPTION OF THE INVENTION

In general, an electrostatic actuator apparatus, process of forming thereof, and method of actuation is described in which a flexible member having opposing surface electrodes positioned between two substrates having opposing surface electrodes is caused to move by charging and discharging the opposing flexible member electrodes during first and second operative cycles. In one embodiment, the actuator is fabricated using semiconductor processing techniques so as to produce a small scale actuator suitable for use in a micro-electromechanical systems (MEMS).

Figure 1A:
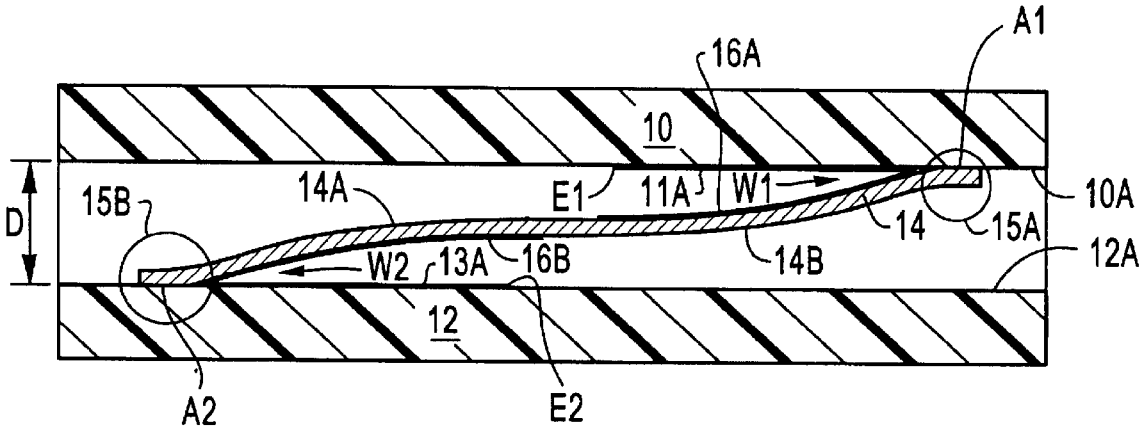
FIG. 1A shows a first embodiment of an actuator apparatus according to the present invention.

FIG. 1A shows a first embodiment of an electrostatic actuator according to the present invention including a first substrate 10 having a first surface 10A. Disposed on the first surface 10A is a first electrode 11A. The actuator further includes a second substrate 12 having a second surface 12A. Disposed on the second surface 12A is a second electrode 13A. The first and second substrates are space apart by a distance D.

Between the spaced apart surfaces is a flexible member 14 having a first member surface 14A and a second member surface 14B. The first member surface 14A is positioned opposite to the first surface 10A and the second member surface 14B is positioned opposite to the second surface 12A. The flexible member has a first distal end 15A fixedly attached to the first surface 10A at attachment point A1 and a second distal end 15B fixedly attached to the second surface 12A at attachment point A2 as shown in FIG. 1A.

On the first member surface 14A is a third electrode 16A that is positioned opposite to the first electrode 11A. On the second member surface 14B is a fourth electrode 16B that is disposed opposite to the second electrode 13A. The flexible member 14 and associated electrodes form the flexible member electrode assembly.

In essence, opposing electrodes on each of the substrate and flexible member surfaces are charged and discharged during first and second operative cycles so as to cause the flexible member to be alternately drawn to the first and second substrate surfaces. In particular, in a first operative cycle, flexible member electrode 16A is charged and the first electrode 11A is oppositely charged such that the electrode 16A is drawn towards the first surface 10A resulting in a first movement of the flexible member. Also in the first operative cycle, flexible member electrode 16B is discharged. Similarly, in the second operative cycle, flexible member electrode 16B is charged and the second electrode 13A is oppositely charged such that electrode 16B is drawn towards the second surface 12A resulting in a second movement of the flexible member. Also in the second operative cycle, flexible member electrode 16A is discharged. Hence, the charging and discharging of the flexible member electrodes causes it to be alternately drawn to the first and second surfaces causing the flexible member to move between the first and second surfaces resulting in an actuation movement.

As is well known in the field of electronics, charge force is reversely proportional to the distance. Referring to FIG. 1A, due to the wedge area W1 formed at the attachment point A1 of the flexible member to surface 10A, the attraction between the electrodes 11A and 16A during the first operative cycle is the strongest at the corner of the wedge and decreases from that point to the end (E1) of the first electrode 11A. As a result, the third electrode 16A is drawn towards and gradually is pulled into contact with the first electrode 11A starting at the point of attachment (A1) and ending at the opposite end of the first electrode (E1). Note, in order avoid a shorted connection between the electrodes, a non-conductive electrical or mechanical barrier is formed between the first and third electrodes. For instance, a layer of insulating material can be deposited on a portion of the third electrode or can be deposited on the full length of the first electrode to prohibit direct contact between the first and third electrodes. Alternatively, a mechanical barrier can be placed on either the first or third electrodes to prohibit direct contact between them. In one embodiment, the third electrode 16A and the first electrode 11A are oppositely charged (i.e., +V, −V) and the charging electrode 13C and the first electrode 11A are held at fixed voltages by power supplies.

As similarly described above, due to the wedge W2 created between the second and fourth electrodes, the attraction between these electrodes during the second operative cycle is the strongest at the point of attachment A2 and decreases from that point to the end (E2) of the second electrode 13A. As a result, the fourth electrode 16B is drawn towards and gradually is pulled into indirect contact with the second electrode 13A starting at point A2 and ending at point E2. Note, as with the first and third electrodes, in order avoid a shorted connection between the second and fourth electrodes, a non-conductive electrical or mechanical barrier is formed between them. In one embodiment, the fourth electrode 16B and the second electrode 13A are oppositely charged (i.e., +V, −V) and the charging electrode 11C and the second electrode 13A are held at fixed voltages by power supplies.

It should be noted that the circuitry to charge and discharge the electrodes are not shown in FIG. 1A. However, charging and discharging circuitry are well known in the field of basic electronics and is beyond the scope of this description. It should be understood that the charging and discharging circuitry are timed so that the appropriate electrode is charged/discharged during the correct operative cycle. For example, electrode 16A is charged and electrode 16B is discharged during the first operative cycle and electrode 16A is discharged and electrode 16B is charged during the second operative cycle. In one embodiment, charging and discharging circuitry are coupled to electrodes attachment points A1 and A2.

Figure 1B:
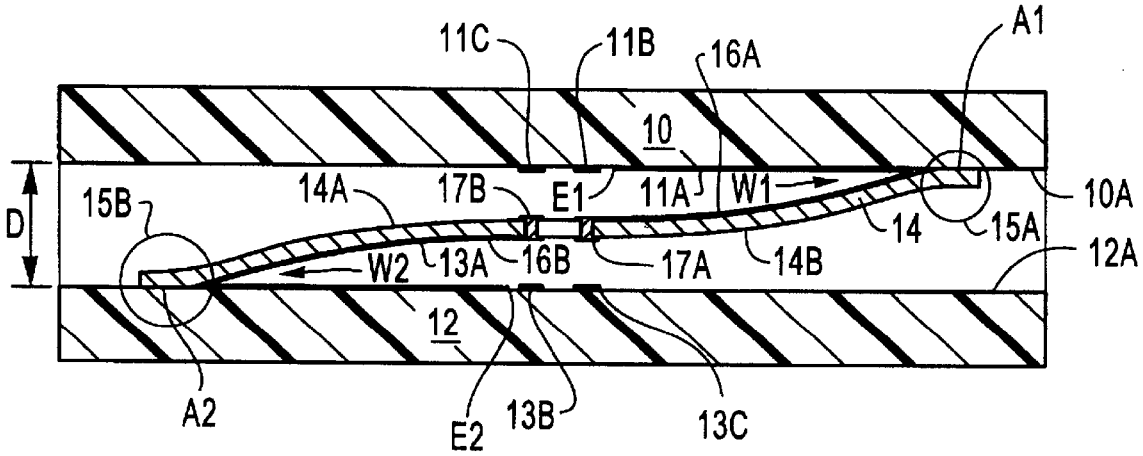
FIG. 1B shows a second embodiment of an actuator apparatus according to the present invention.

FIG. 1B shows a second embodiment of an electrostatic actuator according to the present invention that facilitates self-regulating actuation movement. Specifically, the second embodiment shown in FIG. 1B includes first and second substrates 10 and 12 having first and second surfaces 10A and 12A similar to that shown in FIG. 1A. However, in addition to first electrode 11A, a first surface discharging electrode 11B and a first surface charging electrode 11C are disposed on surface 10A. Similarly, in addition to second electrode 13A, a second surface discharging electrode 13B and a second surface charging electrode 13C are disposed on surface 12A. In one embodiment, the charging electrodes are each coupled to a positive power supply and the discharging electrodes are coupled to ground or a negative potential.

Between the spaced apart substrate surfaces is the flexible member 14 having a first member surface 14A and a second member surface 14B each including third and fourth electrodes 16A and 16B, respectively. Similar to the embodiment shown in FIG. 1A, the first member surface 14A is positioned opposite to the first surface 10A and the second member surface 14B is positioned opposite to the second surface 12A. The flexible member has a first distal end 15A fixedly attached to the first surface 10A at attachment point A1 and a second distal end 15B fixedly attached to the second surface 12A at attachment point A2.

The second embodiment shown in FIG. 1B further includes an electrode portion 17A corresponding to and in conductive contact with the third electrode 16A that is disposed on the second member surface 14B. In addition, the actuator apparatus shown in FIG. 1B includes an electrode portion 17B corresponding to and in conductive contact with fourth electrode 16B that is disposed on the first member surface 14A.

In essence, the apparatus shown in FIG. 1B is made up of two electrode assemblies each including a charging and a discharging electrode for charging and discharging an electrode on the flexible member during the first and second operative cycles. A description of one embodiment of operation of the actuator shown in FIG. 1B is now provided. The operation includes a first operative cycle in which the flexible member 14 is in a first operative position in which the third electrode portion 17A (associated with the third electrode 16A) is in contact with the charging electrode 13C. Charging electrode 13C charges third electrode portion 17A to a first voltage potential. Since the third electrode portion 17A is in electrical contact with third electrode 16A, it too is charged to a first voltage potential. Also during the first operative cycle, the first electrode 11A is at a second voltage potential and electrode 16B is in contact with discharging electrode 13B such that electrode 16B is in a discharged state. The first and second voltage potentials are such that as the third electrode 16A is charged it is drawn towards the first electrode 11A on the first surface 10A.

As similarly described above, due to the wedge area W1 created between the first and third electrodes, the attraction between the electrodes is the strongest at the point of attachment A1 and decreases from that point to the end (E1) of the first electrode 11A. As a result, the third electrode 16A is drawn towards and gradually is pulled into contact with the first electrode 11A starting at the point of attachment (A1) and ending at the opposite end of the first electrode (E1). Note, in order avoid a shorted connection between the electrodes, a non-conductive electrical or mechanical barrier is formed between the first and third electrodes as described above.

In a second operative cycle, the third electrode 16A (once being drawn towards and pulled in indirect contact with the first electrode 11A) is in conductive contact with discharging electrode 11B and the fourth electrode portion 17B is in conductive contact with the charging electrode 11C. As a result, the third electrode 16A is discharged through electrode 11B while the fourth electrode portion 17B is charged to a third voltage. Due to the connection between electrode portion 17B and electrode 16B, electrode 16B is also charged by electrode 11C. Electrode 13A is at a fourth voltage. The third and fourth voltage potentials are such that as the fourth electrode 16B is charged it is drawn towards the second electrode 13A on the first surface 12A. As similarly described above, due to the wedge W2 created between the second and fourth electrodes, the attraction between the electrodes is the strongest at the point of attachment A2 and decreases from that point to the end (E2) of the second electrode 13A. As a result, the fourth electrode 16B is drawn towards and gradually is pulled into indirect contact with the second electrode 13A starting at point A2 and ending at point E2. Note, as with the first and third electrodes, in order avoid a shorted connection between the second and fourth electrodes, a non-conductive electrical or mechanical barrier is formed between them. In one embodiment, the fourth electrode 16B and the second electrode 13A are oppositely charged (i.e., +V, −V) and the charging electrode 11C and the second electrode 13A are held at fixed voltages by power supplies.

Figure 1C:
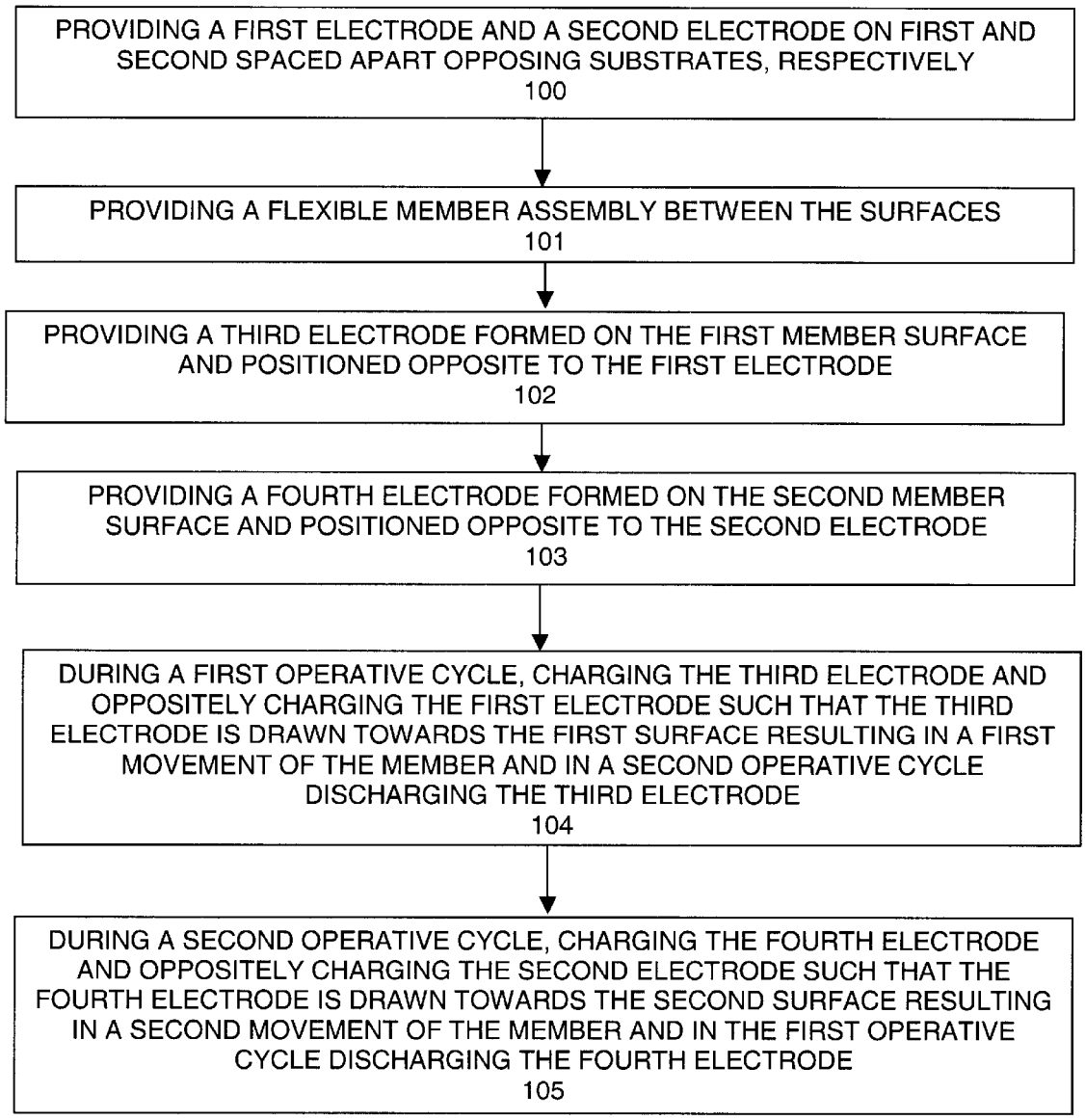
FIG. 1C shows a first embodiment of a method of actuation according to the present invention.

Hence in accordance with the above described operation, a first embodiment of a method of actuation is shown in FIG. 1C. In accordance with this method an actuator is provided as shown in FIG. 1A. In particular, the following are provided: 1) a first electrode and a second electrode on first and second spaced apart opposing substrates, respectively, (100); 2) a flexible member assembly between the surfaces (101); 3) a third electrode that is formed on the first member surface and positioned opposite to the first electrode (102); and 4) a fourth electrode that is formed on the second member surface and positioned opposite to the second electrode (103). During a first operative cycle, the third electrode portion is charged and the first electrode is oppositely charged such that the third electrode is drawn towards the first surface resulting in a first movement of the member (104). In a second operative cycle, the third electrode is discharged (104). Furthermore, during the second operative cycle, the fourth electrode portion is charged and the second electrode is oppositely charged such that the fourth electrode is drawn towards the second surface resulting in a second movement of the member (105). In the first operative cycle the fourth electrode is discharged (105).

Figure 1D:
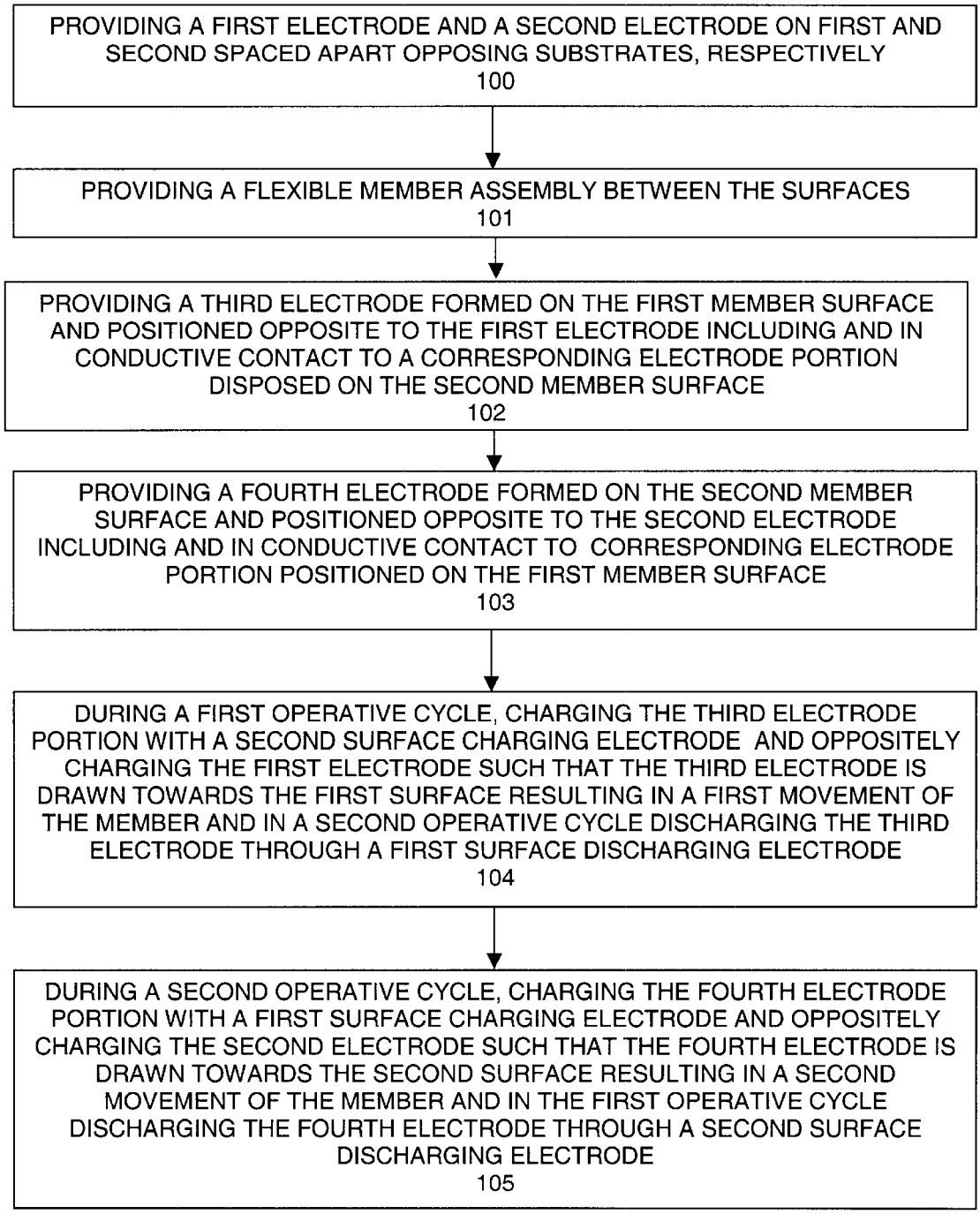
FIG. 1D shows a second embodiment of a method of actuation according to the present invention.

A second embodiment of a method of actuation is shown in FIG. 1D corresponding to the actuator shown in FIG. 1B. In accordance with this method an actuator is provided as shown in FIG. 1B including 1) first and second electrodes on first and second spaced apart opposing substrates, respectively, (106); 2) a flexible member assembly between the surfaces (107); 3) a third electrode that is formed on the first member surface and positioned opposite to the first electrode, where the third electrode includes and is in conductive contact to a corresponding third electrode portion that is disposed on the second member surface (108); and 4) a fourth electrode that is formed on the second member surface and positioned opposite to the second electrode, where the fourth electrode includes and is in conductive contact to a corresponding fourth electrode portion that is disposed on the first member surface (109). During a first operative cycle, the third electrode portion is charged by a second surface charging electrode and the first electrode is oppositely charged such that the third electrode is drawn towards the first surface resulting in a first movement of the member (110) through a first surface discharging electrode. In a second operative cycle, the third electrode is discharged (110). Furthermore, during the second operative cycle, the fourth electrode portion is charged with a first surface charging electrode and the second electrode is oppositely charged such that the fourth electrode is drawn towards the second surface resulting in a second movement of the member (111). In the first operative cycle the fourth electrode is discharged through a second surface discharging electrode (111).

Figure 2:
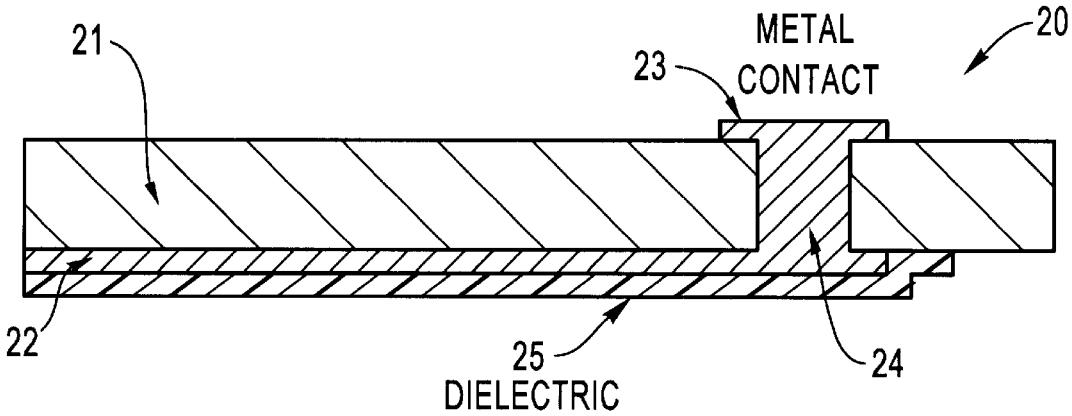
FIG. 2 shows an embodiment of a portion of the flexible member assembly according to the present invention.

FIG. 2 shows one embodiment of a portion of the flexible member assembly 20 according to the present invention. The assembly includes a portion of the flexible member 21, a part of a first electrode 22 corresponding to either of electrodes 16A or 16B shown in FIG. 1B and a part of a second electrode 23 corresponding to either of electrodes 17A or 17B shown in FIG. 1B. Electrodes 22 and 23 are in electrical contact by a via 24 formed in the flexible member portion 21. In one embodiment, flexible member portion 21 is one of polyimide, polyetherimide, polyetheretherketone, and polyester. In one embodiment, electrodes 22 and 23 and via 24 are composed of one of gold, aluminum, copper, and nickel. Also shown in FIG. 2 is an insulating layer 25 that creates an electrical insulating barrier between the flexible member electrode and the surface electrode on each of the spaced apart electrodes as previously described.

Figure 3:
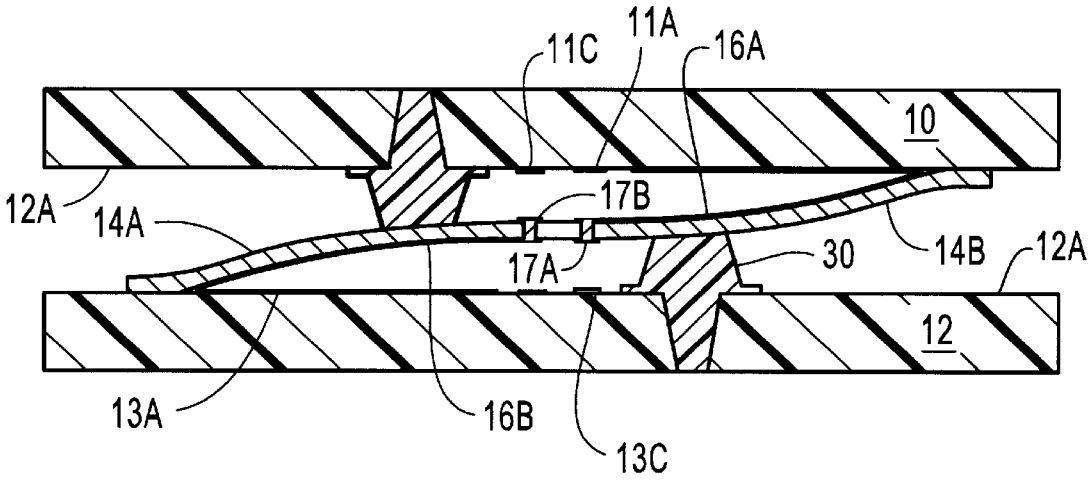
FIG. 3 shows a second embodiment of an actuator apparatus according to the present invention including pumping elements.

In an alternative embodiment, the actuator apparatus further includes a pumping element responsive to the actuation motion of the actuator apparatus. FIG. 3, shows an embodiment of the actuator apparatus including a pumping element having a flexible membrane 30 that forms a cavity 31 for containing a fluid. The pumping element further includes an orifice 32. When the flexible member 14 moves between the first and second surfaces (10A and 12A) resulting in an actuation movement as described above, the flexible member 14 compresses the flexible membrane 30 causing the fluid to be expelled from the orifice 32. In the embodiment shown in FIG. 2, two pumping elements are shown such that each of the pumping elements is actuated during one of the first or second operative cycles. It should be understood that the actuator assembly can include one or more pumping assemblies.

In one embodiment (not shown), the first and second substrates form a closed cavity that is in fluid communication with a one way valve, referred to as a check valve. In this embodiment, the value(s) regulate the fluid flow into and out of the cavity and the actuator causes the fluid to be expelled from the cavity through the values.

In one embodiment, the actuator including the pumping element is used to deposit drops of ink on media in an inkjet printing system. In this embodiment, the actuator is controlled by control signals corresponding to image data to cause the ink to be pumped by the actuator to form a pattern of drops corresponding to the image data.

Figure 4:
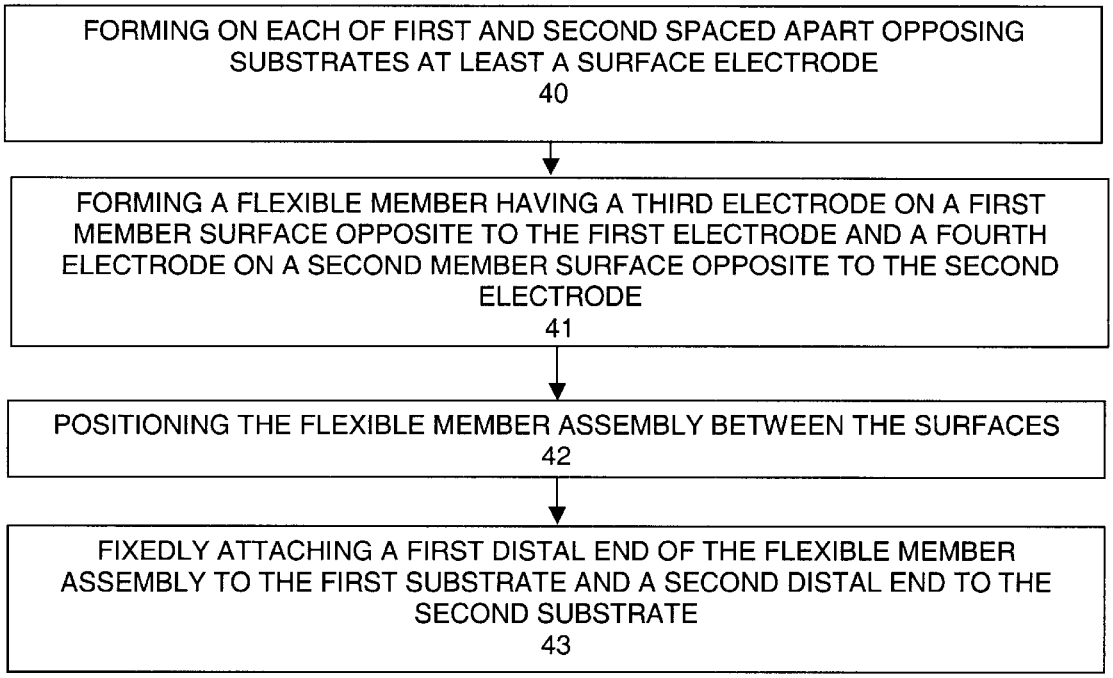
FIG. 4 shows a first embodiment of a process of forming an actuation apparatus according to the present invention.

In one embodiment, the actuator can be formed using semiconductor processing. FIG. 4 shows a first embodiment of process of forming an actuator including forming on each of first and second spaced apart substrates, at least surface electrode and a charging electrode and a discharging electrode (40). The process further includes forming a flexible member having at least a third electrode on a first member surface opposite to the first substrate electrode and a fourth electrode on a second member surface opposite to the second substrate electrode (41). The process can include forming a third electrode portion on the second member surface opposite to the second surface electrode and in conductive contact to the third electrode (42) and forming a fourth electrode on the first member surface opposite to the first electrode (43). The process further includes positioning the flexible member assembly between the surfaces (44) and fixedly attaching a first distal end of the flexible member assembly to the first substrate and a second distal end to the second substrate (45).

In another embodiment, the surface, charging, and discharging electrodes are formed on the substrates by depositing a layer of conductive material on each of the spaced apart substrate surfaces and then patterning the conductive layer to form the electrodes. In one embodiment, the dielectric can be formed on either the surface electrodes or the flexible member surface electrodes by CVD deposition or by sputtering, however any other technique of formation is within the scope of the present invention. The flexible member assembly can be formed by depositing and patterning a layer of conductive material on each of the first and second member surfaces. As an exemplary embodiment, the distal ends of the flexible member can be attached to each of the spaced apart substrate surfaces by using an adhesive, by fusing (e.g., laser fusing, heat fusing) or by soldering. The conductive path between each of the flexible member electrodes and corresponding electrode portions is formed by creating a via through the flexible member and filing the via with a conductive material such that when conductive layers are deposited on top of the via on either side of the flexible member are on electrical contact.

In the preceding description, numerous specific details are set forth in order to provide a thorough understanding of the present invention. It will be apparent, however, to one skilled in the art that these specific details need not be employed to practice the present invention. In addition, it is to be understood that the particular embodiments shown and described by way of illustration is in no way intended to be considered limiting. Reference to the details of these embodiments is not intended to limit the scope of the claims.

I claim:

1. An electrostatic actuator apparatus comprising:

first and second spaced apart substrates having first and second opposing surfaces, respectively, each surface having a first electrode and a second electrode, respectively;

flexible member positioned between the surfaces and having a first member surface positioned opposite to the first surface and a second member surface positioned opposite to the second surface, the flexible member having a first distal end fixedly attached to the first surface and having a second distal end fixedly attached to the second surface;

third electrode formed on the first member surface and positioned opposite to the first electrode;

fourth electrode formed on the second member surface and positioned opposite to the second electrode;

wherein in a first operative cycle the third electrode is charged thereby causing the third electrode to be drawn towards the first surface resulting in a first movement of the member and in a second operative cycle the third electrode is discharged;

wherein in the second operative cycle the fourth electrode is charged thereby causing the fourth electrode to be drawn towards the second surface resulting in a second movement of the member and in the first operative cycle the fourth electrode is discharged.

2. The apparatus as described in claim 1 further comprising:

first and second surface charging electrodes on the first and second surfaces, respectively;

first and second surface discharging electrodes on the first and second surfaces, respectively a third electrode portion corresponding to and in conductive contact with the third electrode and formed on the second member surface;

a fourth electrode portion corresponding to and in conductive contact with the fourth electrode and formed on the first member surface;

wherein in the first operative cycle the third electrode portion is in contact with the second surface charging electrode thereby causing the third electrode to be charged and in a second operative cycle the third electrode is in contact with the first electrode and the first surface discharging electrode thereby causing the third electrode to be discharged;

wherein in the second operative cycle the fourth electrode portion is in contact with the first surface charging electrode thereby causing the fourth electrode to be charged and in the first operative cycle the fourth electrode is in contact with the second surface discharging electrode thereby causing the fourth electrode to be discharged.

3. The apparatus as described in claim 1 wherein the combination of the first movement and the second movement causes a displacement of one of fluid and air.

4. The apparatus as described in claim 1 wherein the first and second substrates comprise semiconductors.

5. The apparatus as described in claim 2 wherein the first electrode, the first charging electrode, and the first discharging electrode are formed from a first layer of conductive material deposited on the first surface and then patterned and wherein the second electrode, the second charging electrode, and the second discharging electrode are formed from a second layer of conductive material deposited on the second surface.

6. The apparatus as described in claim 2 wherein the third electrode portion is conductively connected to a path formed between the first member surface and the second member surface.

7. The apparatus as described in claim 6 wherein the conductive path is a via filled with conductive material.

8. The apparatus as described in claim 2 wherein one of the first electrode and the third electrode is covered by a dielectric layer.

9. The apparatus as described in claim 1 further comprising at least one pumping element formed on one of the first and second surfaces, the pumping element including at least one flexible membrane and a nozzle for containing a fluid, wherein the flexible membrane is compressed by one of the first and second movements of the flexible member causing the fluid to be expelled from the nozzle.

10. The apparatus as described in claim 1 further comprising at least one pumping element containing fluid and including a nozzle wherein one of the first and second movements of the flexible member causes the fluid to be expelled from the nozzle.

11. A method of electrostatic actuation comprising:

providing first and second spaced apart substrates having first and second opposing surfaces, respectively, each surface having a first electrode and a second electrode, respectively;

providing a flexible member between the surfaces and having a first member surface positioned opposite to the first surface and a second member surface positioned opposite to the second surface, the flexible member having a first distal end fixedly attached to the first surface and having a second distal end fixedly attached to the second surface;

providing a third electrode formed on the first member surface and positioned opposite to the first electrode;

providing a fourth electrode formed on the second member surface and positioned opposite to the second electrode;

during a first operative cycle, charging the third electrode and oppositely charging the first electrode such that the third electrode is drawn towards the first surface resulting in a first movement of the member and in a second operative cycle discharging the third electrode;

during a second operative cycle, charging the fourth electrode and oppositely charging the second electrode such that the fourth electrode is drawn towards the second surface resulting in a second movement of the member and in the first operative cycle discharging the fourth electrode.

12. The method of electrostatic actuation further comprising:

providing a third electrode portion on the second member surface corresponding to an in conductive contact with the third electrode;

providing a fourth electrode portion on the first member surface corresponding to and in conductive contact to the fourth electrode;

during a first operative cycle, charging the third electrode portion through the third electrode portion with a second surface charging electrode so as to charge the third electrode and in a second operative cycle discharging the third electrode through a first surface discharging electrode;

during a second operative cycle, charging the fourth electrode portion through the fourth electrode portion with a first surface charging electrode so as to charge the fourth electrode and in the first operative cycle discharging the fourth electrode through a second surface discharging electrode.

13. The method as described in claim 11 further comprising providing at least one pumping element formed on one of the first and second surfaces, the pumping element including at least one flexible membrane and a nozzle for containing a fluid, wherein the flexible membrane is compressed by one of the first and second movements of the flexible member causing the fluid to be expelled from the nozzle.

14. The method as described in claim 13 wherein the fluid is ink that is expelled onto media.

15. A process of forming an actuator apparatus comprising:

forming on each of first and second spaced apart opposing substrates having first and second surfaces, respectively, at least a surface electrode;

forming a flexible member having at least a third electrode on a first member surface opposite to the first surface electrode and at least a fourth electrode on a second member surface opposite to the second surface electrode;

positioning the flexible member assembly between the surfaces;

fixedly attaching a first distal end of the flexible member assembly to the first substrate and a second distal end to the second substrate.

16. The process of forming an actuator apparatus as described in claim 15 further comprising:

forming on each of first and second spaced apart opposing substrates a charging electrode and a discharging electrode;

forming a third electrode portion on the second member surface opposite to the second surface electrode and in conductive contact to the third electrode;

forming a fourth electrode portion on the first member surface opposite to the first surface electrode and in conductive contact to the fourth electrode.

17. The process as described in claim 16 conductively connecting the third electrode and its corresponding third electrode portion with a path formed between the first member surface and the second member surface and conductively connecting the fourth electrode and its corresponding fourth electrode portion with a path formed between the first member surface and the second member surface.

18. The process as described in claim 17 comprising forming the conductive path with a via filled with conductive material.

19. The process as described in claim 16 comprising forming the first and second surface electrodes, the charging electrodes, and the discharging electrodes by:

depositing a layer of conductive material on each of the first and second surfaces; and patterning the layer of conductive material.

20. The process as described in claim 19 comprising depositing a layer of dielectric material on the patterned first and second surface electrodes.

21. The process as described in claim 16 comprising forming the third electrode and its corresponding electrode portion and the fourth electrode and its corresponding electrode portion by:

depositing a layer of conductive material on each of the first and second member surfaces; and patterning the conductive layer.

* * * * *